United States Patent [19]

Flanagan

[11] 4,234,363

[45] Nov. 18, 1980

[54] SOLID PROPELLANT HYDROGEN GENERATOR

[75] Inventor: Joseph E. Flanagan, Woodland Hills, Calif.

[73] Assignee: Rockwell International Corporation, El Segundo, Calif.

[21] Appl. No.: 593,599

[22] Filed: Jul. 2, 1975

Related U.S. Application Data

[63] Continuation-in-part of Ser. No. 371,928, Jun. 11, 1973, abandoned.

[51] Int. Cl.[3] ..... C06B 45/10

[52] U.S. Cl. ..... 149/19.4; 149/19.5; 149/19.9; 149/47; 149/92

[58] Field of Search ..... 149/19.1, 19.4, 19.5, 149/19.9, 47, 92

[56] References Cited

U.S. PATENT DOCUMENTS

| | | | |
|---|---|---|---|
| 3,177,101 | 4/1965 | Vriesen | 149/19.5 |
| 3,362,859 | 1/1968 | Sutton et al. | 149/92 X |
| 3,473,981 | 10/1969 | Butts | 149/92 X |
| 3,677,841 | 7/1972 | Ayres et al. | 149/92 |
| 3,697,339 | 10/1972 | Sarten et al. | 149/19.1 X |
| 3,697,341 | 10/1972 | Rosher | 149/92 |
| 3,723,130 | 5/1973 | Flanagan et al. | 149/92 X |
| 3,752,703 | 8/1973 | Toy et al. | 149/19.1 |

*Primary Examiner*—Edward A. Miller

*Attorney, Agent, or Firm*—H. Fredrick Hamann; Robert M. Sperry

[57] ABSTRACT

A solid propellant hydrogen generator for chemical laser systems and the like comprising an oxidizer, a fuel, and a binder formulated to provide a stoichiometry which will maximize the hydrogen exhaust components while minimizing exhaust outputs of $CH_4$, $CO_2$ and $H_2O$ and yielding flame temperatures above 1200° K.

5 Claims, No Drawings

SOLID PROPELLANT HYDROGEN GENERATOR

CROSS-REFERENCE TO RELATED APPLICATIONS

This application is a continuation-in-part of application Ser. No. 371,928, filed June 11, 1973, and now abandoned.

BACKGROUND OF THE INVENTION

1. Field of Invention

This invention relates to gas generators and is particularly directed to solid propellant hydrogen gas generators.

2. Prior Art

Solid propellants have long been known, for use as rocket fuels, gun propellants and the like. However, these propellants have been formulated to produce propulsion energy, with little, if any, concern regarding the products of combustion. Most prior art solid propellant formulations have yielded relatively small amounts of hydrogen. However, with the development of chemical laser systems, there has arisen a requirement for solid propellant gas generators capable of yielding substantial quantities of hydrogen. Moreover, the known materials for making solid propellant formulations also include substantial quantities of carbon and oxygen and, when the ratio of oxygen to carbon is in the range of about 1.2/1 to 2.0/1, it is found that significant amounts of water and small amounts of $CO_2$ are created in the products of combustion. For many purposes, the creation of such water and $CO_2$ are immaterial. However, in chemical laser systems and the like, the presence of water and $CO_2$ may be deleterious or may even prevent operation. Other formulations have provided oxygen to carbon ratios of 1/1, but have provided relatively low flame temperatures which have resulted in production of $CH_4$ in the combustion products. Unfortunately, the presence of $CH_4$ is also undesirable for some purposes. Furthermore, many prior art solid propellant formulations emit halides in the products of combustion. However, the presence of halides cannot be tolerated in gas generators for use in chemical laser systems. Thus, none of the solid propellant hydrogen generators of the prior art have been entirely satisfactory.

BRIEF SUMMARY AND OBJECTS OF THE INVENTION

These disadvantages of the prior art are overcome with the present invention and solid propellant hydrogen gas generators are provided which produce little or no water, $CH_4$, $CO_2$ or halides.

The advantages of the present invention are preferably attained by providing solid propellant hydrogen generators comprising an oxidizer, a fuel, and a binder formulated to maximize hydrogen exhaust components while maintaining the oxygen to carbon stoichiometry at about 1/1 and providing flame temperature above 1200° K. to minimize or eliminate water, $CO_2$, and $CH_4$ in the exhaust.

Accordingly, it is an object of the present invention to provide improved solid propellant hydrogen generators.

Another object of the present invention is to provide solid propellant hydrogen generators which produce little or no water, $CO_2$, $CH_4$ or halides as exhaust components.

A further object of the present invention is to provide a solid propellant hydrogen generator which produces a mole percent of hydrogen which is at least ten times greater than the combined mole percentages of the deleterious gaseous products.

A specific object of the present invention is to provide solid propellant hydrogen generators for chemical laser systems and the like comprising an oxidizer, a fuel, and a binder formulated to maximize hydrogen exhaust components while maintaining the oxygen to carbon stoichiometry at about 1/1 and providing flame temperatures above 1200° K. to minimize or eliminate water, $CO_2$ and $CH_4$ in the exhaust.

These and other objects and features of the present invention will be apparent from the following detailed description.

DETAILED DESCRIPTION OF INVENTION

In that form of the present invention chosen for purposes of illustration, a solid propellant gas generator for chemical laser systems and the like is provided comprising an oxidizer, a fuel, and a binder formulated to maximize hydrogen exhaust components while maintaining the oxygen to carbon stoichiometry at about 1/1 and providing flame temperatures above 1200° K. to minimize or eliminate water, $CO_2$, and $CH_4$ in the exhaust.

PRIOR ART FORMULATION

A typical prior art formulation for a solid propellant hydrogen generator would comprise 80%, by weight, of ammonium nitrate, as an oxidizer, with 20%, by weight, of polytubadiene as a fuel.

When burned, this provides a flame temperature of 1500° K. and yields the following exhaust components (all percentages recited in this application are by weight):

| | |
|---|---|
| $H_2$ | 21.9% |
| $H_2O$ | 34.8% |
| CO | 14.6% |
| $CO_2$ | 7.3% |
| $N_2$ | 21.6% |
| $CH_4$ | — |
| C (solid) | — |
| Other | 0.7% |

If the proportions of the ingredients are taliored so as to give an oxygen-to-carbon ratio of 1/1, the flame temperature is drastically reduced (to about 1000° K.), which results in the formation of large amounts of $CH_4$ and unburned carbon.

EXAMPLE I

In accordance with the present invention, a solid propellant hydrogen generator has been formulated consisting of 45% triaminoguanidine nitrate, as an oxidizer, 25% triaminiguanidine-5-amino tetrazole, as a fuel, 13.2% of a polyester (such as that available commercially, under the designation "R-18", from Mobay Chemical Inc., of Pittsburgh, Pennsylvania), as a fuel and binder, 1.8% polymethylene polyphenyl isocyanate, as additional fuel and binder, and 15.0% trimethyolethane trinitrate, as an oxidizing plasticizer.

This formulation burns at a flame temperature of 1210° K. and yields the following exhaust components:

| | |
|---|---|
| $H_2$ | 41.1% |
| $H_2O$ | 1.3% |
| CO | 24.4% |
| $CO_2$ | 0.6% |
| $N_2$ | 31.2% |
| $CH_4$ | 1.1% |
| C (solid) | 0.3% |
| Other | — |

EXAMPLE II

A solid propellant hydrogen generator has been formulated consisting of 30% triaminoguanidine nitrate, as an oxidizer, 10% triaminoguanidine-5-amino tetrazole, as a fuel, 30% 1.6-diazido-2, 5-dinitrazahexane, as additional oxidizer, 14.1% of a polyester, such as "R-18", referred to above, as a fuel and binder, 1.9% polymethylene polyphenyl isocyanate, as additional fuel and binder, and 14.0% trimethyolethane trinitrate, as an oxidizing plasticizer.

This formulation burns at a flame temperature of 1450° K. and yields the following exhaust components:

| | |
|---|---|
| $H_2$ | 40.5% |
| $H_2O$ | 0.6% |
| CO | 31.0% |
| $CO_2$ | 0.2% |
| $N_2$ | 27.7% |
| $CH_4$ | — |
| C (solid) | — |
| Other | — |

EXAMPLE III

A solid propellant hydrogen generator has been formulated consisting of 58% cyclotetramethylene tetranitramine, as an oxidizer, 22% ammonium nitrate, as additional oxidizer, 2.0% polymethylene polyphenyl isocyanate, as a fuel and binder, and 20.0% polybutadiene, as a fuel.

This formulation burns at a flame temperature of 1550° K. and yields the following exhaust components:

| | |
|---|---|
| $H_2$ | 41.6% |
| $H_2O$ | 0.5% |
| CO | 39.7% |
| $CO_2$ | 0.2% |
| $N_2$ | 17.8% |
| $CH_4$ | 0.2% |
| C (solid) | — |
| Other | — |

EXAMPLE IV

A solid propellant hydrogen generator has been formulated consisting of 68% 1,7-diazido-2,4,6-trinitrazine heptane, as an oxidizer, 7.0% ammonium nitrate, as additional oxidizer, 22% of a polyester, such as "R-18", referred to above, as a fuel and binder, and 3.0% polymethylene polyphenyl isocyanate, as additional fuel and binder.

This formulation burns at a flame temperature of 1830° K. and yields the following exhaust components:

| | |
|---|---|
| $H_2$ | 35.4% |
| $H_2O$ | 0.3% |
| CO | 38.4% |
| $CO_2$ | 0.1% |
| $N_2$ | 25.8% |
| $CH_4$ | — |
| C (solid) | — |
| Other | — |

It will be seen that each of the formulations of Examples I, II, III and IV yields one and one-half to two times as much hydrogen as the prior art formulation, with only trace amounts of water and little, if any, carbon dioxide, methane, solid carbon or other deleterious exhaust components.

Obviously, numerous other variations and modifications may be made without departing from the present invention. Accordingly, it should be clearly understood that the forms of the present invention described above are illustrative only and are not intended to limit the scope of the present invention.

I claim:

1. A solid propellant hydrogen generator comprising:
an oxidizer selected from the group consisting of triaminoguanidine nitrate, diazidodinitrazahexane, diazidotrinitrazaheptane, ammonium nitrate, and cyclotetramethylene tetranitramine;
a fuel selected from the group consisting of triaminoguanidine-5-amino tetrazole and the double salt of triaminoguanidine and azotetrazole;
and a binder selected from the group consisting of polyesters, polyethers and polybutadiene;
said oxidizer, fuel and binder being formulated to maximize hydrogen exhaust components while maintaining the oxygen to carbon stoichiometry at about 1/1 and providing flame temperatures above 1200° K.

2. A solid propellant hydrogen generator consisting of:
45% by weight triaminoguanidine nitrate,
25% by weight triaminoguanidine-5-amino tetrazole,
13.2% by weight polyester
1.8% by weight isocyanate, and
15% by weight trimethyolethane trinitrate.

3. A solid propellant hydrogen generator consisting of:
30% by weight triaminoguanidine nitrate,
10% by weight triaminoguanidine-5-amino tetrazole,
30% by weight diazidodinitrahexane,
14.1% by weight polyester,
1.9% by weight isocyanate, and
14% by weight trimethyolethane trinitrate.

4. A solid propellant hydrogen generator consisting of:
58% by weight cyclotetramethylene tetranitramine
22% by weight ammonium nitrate,
2.0% by weight isocyanate, and
20% by weight polybutadiene.

5. A solid propellant hydrogen generator consisting of:
68% by weight diazidotrinitrazaheptane,
7% by weight ammonium nitrate,
22% by weight polyester, and
3% by weight isocyanate.

* * * * *